US006473941B2

(12) United States Patent
Mei et al.

(10) Patent No.: US 6,473,941 B2
(45) Date of Patent: Nov. 5, 2002

(54) FASTENING ASSEMBLY AND METHOD FOR ELECTRONIC DEVICES

(76) Inventors: David Mei, 99-14 74th Ave., Forest Hills, NY (US) 11375; Jin-Xia Bao, 99-14 74th Ave., Forest Hills, NY (US) 11375

( * ) Notice: Subject to any disclaimer, the term of this patent is extended or adjusted under 35 U.S.C. 154(b) by 59 days.

(21) Appl. No.: 09/733,321

(22) Filed: Dec. 8, 2000

(65) Prior Publication Data

US 2002/0069487 A1 Jun. 13, 2002

Related U.S. Application Data

(60) Provisional application No. 60/222,445, filed on Aug. 1, 2000.

(51) Int. Cl.[7] ..... A44B 21/00; A45F 5/00; B65D 77/00

(52) U.S. Cl. ..... 24/3.1; 24/3.13; 24/462; 24/561; 224/222

(58) Field of Search ..... 24/3.1, 3.13, 462, 24/561; 224/222

(56) References Cited

U.S. PATENT DOCUMENTS

| | | | | |
|---|---|---|---|---|
| 2,966,356 A | | 12/1960 | Wilson et al. | |
| 3,148,812 A | * | 9/1964 | Hilsinger, Jr. | 224/5 |
| 3,370,236 A | | 2/1968 | Walker | |
| 3,850,352 A | * | 11/1974 | Reiner | 224/26 B |
| 3,970,228 A | * | 7/1976 | Keller | 224/5 H |
| 4,303,187 A | * | 12/1981 | Berman | 224/222 |
| 5,119,979 A | | 6/1992 | Kallman | |
| 5,201,858 A | | 4/1993 | Otrusina | |
| 5,472,317 A | | 12/1995 | Field et al. | |
| 5,638,581 A | * | 6/1997 | Burke | 24/30.5 R |
| 5,729,869 A | | 3/1998 | Anscher | |
| 5,839,173 A | * | 11/1998 | Otrusina | 24/597 |
| 5,957,357 A | * | 9/1999 | Kallman | 224/675 |
| 5,957,421 A | | 9/1999 | Barbour | |
| 6,085,393 A | * | 7/2000 | Tsui et al. | 24/3.12 |

FOREIGN PATENT DOCUMENTS

| | | | | |
|---|---|---|---|---|
| GB | 0298452 | * | 10/1928 | 24/3.1 |
| GB | 0315982 | * | 7/1929 | 24/3.1 |
| JP | 4187102 | * | 7/1992 | 24/3.1 |

OTHER PUBLICATIONS

WWD Newspaper, Monday, Nov. 20, 2000, vol. 180, No. 96, p. 7.

The Eighth Annual Internet World Fall 2000 Conference Oct. 23–27, 2000, p. 9.

* cited by examiner

*Primary Examiner*—Victor Sakran
(74) *Attorney, Agent, or Firm*—Collard & Roe, P.C.

(57) ABSTRACT

A fastening assembly and method uses a belt loop/snap arrangement in which a belt loop of a pair of pants or other garment is combined with a female or male snap part. The other mating snap part half (male or female) is attached to the bag or carrying case of an electronic device such as a cellular phone, CD player, or wearable computers, etc. The belt loops on which the snap parts are attached can be sewn on pants in vertical, horizontal and criss-cross arrangements to form "I" type, "H" type, "X" type, "Y" type and "V" type arrangements. The snap fasteners are preferably placed on the middle area of the belt loop and at the center to about the upper ⅓ to ⅕ of the back side of the bag or carrier for the electronic device.

9 Claims, 4 Drawing Sheets

FASTENING ASSEMBLY AND METHOD FOR ELECTRONIC DEVICES

CROSS-REFERENCE TO RELATED APPLICATION

This application is based on now abandoned provisional application No. 60/222,445, filed Aug. 1, 2000.

BACKGROUND OF THE INVENTION

1. Field of the Invention

The present invention relates to a fastening assembly for electronic devices and more particularly to a fastening assembly and method for fastening an electronic device, such as a cellular phone, onto an article of clothing.

2. The Prior Art

Mini compact electronic devices, such as cellular telephones, internet wireless communicators, CD players, MP3 music players, mini electronic games, etc., have become more and more popular. Users of these devices have begun to carry them day and night. Although the concept of a wearable computer has been discussed and studied for years, there is still a need for a way for users to carry these extremely small electronic devices with them more conveniently. It is inconvenient and uncomfortable for users to put these mini compact electronic devices into their pockets or hang them onto their waist belts, particularly in the summer when light clothes are worn. Some styles of pants, for example Capri pants, may be worn without a waist belt which makes carrying such devices more difficult.

Although people have traditionally hung compact electronic devices like pagers and cellular phones on their waist belts, this method of carrying the devices is unsatisfactory. First, because the hanging direction of those devices is fixed in a single vertical direction, this arrangement causes inconvenience and discomfort when the wearer sits or bends down. Second, in these prior arrangements, the entire weight of the electronic device is directly added to the waist belt of the wearer's pants, and causes the wearer to feel as if a relatively heavy weight is hanging from their waist belts. Third, as stated previously, many pants and skirts have no waist belts. In that case, some people hang their mini compact electronic devices on the top edge of the garment's waist band. That arrangement, however, causes the top of the waist band to be pulled down by the hanging device.

Some pants have specially designed cellular phone pockets in which the wearer may place the cellular phone. However, these pockets are small and narrow and are limited for use with cellular phones, not for other devices having a different size and shape. In fact, these pockets are essentially useless if a person does not want to carry a cellular phone. It is also known to use a clip or a chain or a ring on a belt loop to hang keys, tools, or electronic devices, but such hanging arrangements are too loose, insecure and inconvenient for hanging mini compact electronic devices.

Accordingly, a need exists to overcome the above problems and inconveniences and provide a simple and convenient fastening method and structure to carry a mini compact electronic device on clothing, which is also decorative when the device is not being carried.

SUMMARY OF THE INVENTION

The present invention provides a method and assembly for fastening an electronic device onto a wearer's article of clothing, such as a skirt or pants, preferably using waist belt loops, snaps and the carrier or bag for the electronic device.

In accordance with one embodiment of the invention, one of the plurality of existing loops sewn onto the article of clothing for a belt is given a new function and use for carrying the electronic device. A first snap part adapted to mate with a second snap part is fastened to one of the belt loops, the second snap part is fastened to the carrier for the electronic device, and the two snap parts are fastened together to form a simple and convenient way to carry the device.

In another embodiment, a number of snap parts may be fastened in a line on the belt loop for better support of the electronic device. In a further embodiment, a connecting loop may be fastened to adjoining belt loops to carry the electronic device.

In another embodiment, at least two intersecting loops are fastened to an article of clothing and a first fastener part adapted to mate with a second fastener part attached to the carrier for the electronic device is fastened to the loops where the loops intersect.

In accordance with the invention, a number of snap parts may be attached to the belt loops of a garment and the small bag or carrier storing the mini electronic device can be moved from one snap part to any one of these snap parts and fastened by pressing. This flexibility allows the wearer to keep the electronic device a convenient distance from his or her waist so that wearing the device will be comfortable when the wearer sits or bends down. Moreover, because the female and male snap parts can be rotated when they are pressed together, the carrier or bag can be rotated as well. This flexibility solves the shortcoming of a clip in which the hanging direction is fixed at all times. In contrast, in accordance with the invention, the wearer can rotate the carrier or bag on the snap, for example, at an angle or perpendicular to the vertical, so that the device may be more comfortably worn.

The device will also feel less heavy because the weight of the mini compact electronic devices stored in the bag when snapped on the belt loop is divided among the waist belt loop, waist belt, and waist band, rather than carried directly on the waist belt alone. For pants without a waist belt or a waistband, the snaps can be attached on an appropriate location such as a fake belt loop in order to fasten the bag storing the mini compact electronic device. In that case, the location of the fake belt loop may vary. The snaps and loops also serve a decorative function and may be applied not only on pants and skirts, but also on other garments such as dresses, jackets, or long coats, etc.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
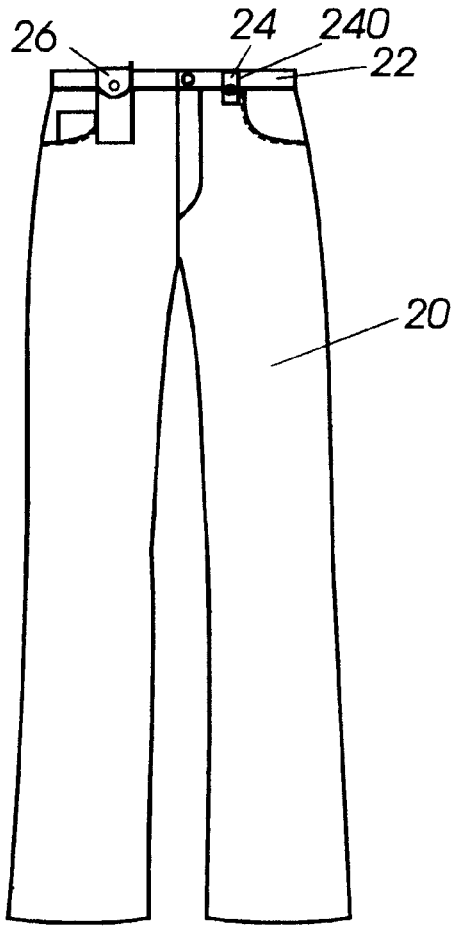
FIG. 1 is a front view of a pair of pants showing a carrier or bag storing a cellular phone fastened on one of the waist belt loops and snaps according to the present invention.
Figure 2:
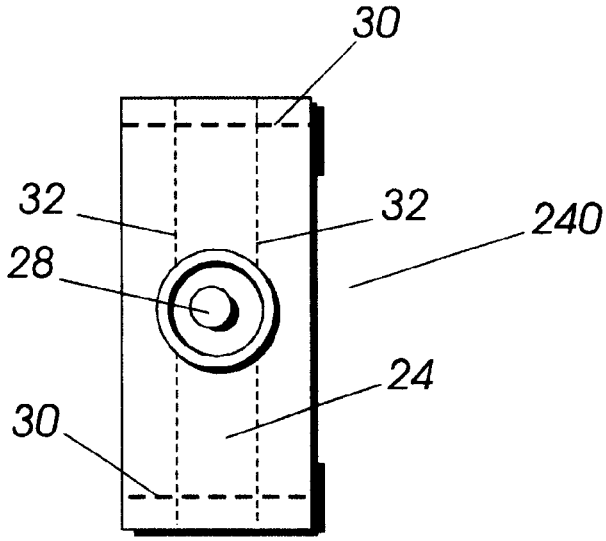
FIG. 2 is an enlarged perspective front view of an "I" type belt loop and snap arrangement according to the present invention.
Figure 3:
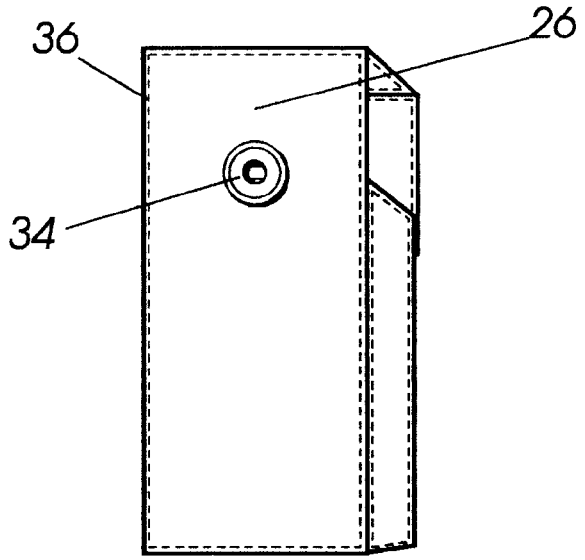
FIG. 3 is a perspective back view of a carrier showing a snap part according to the present invention.

FIGS. 1–3 show the general appearance of the manner in which a small bag or carrier 26 for storing a mini compact electronic device such as a cellular phone is to be snapped on an "I" type belt loop/snap arrangement 240 without using a waist belt. An article of clothing such as a pair of pants 20 has a plurality of loops 24 for a belt sewn on pants 20. A first snap part 28 is fastened to one of the loops 24. First snap part 28 is adapted to mate with a second snap part 34 fastened to the back of carrier 26. First snap part 28 and second snap part 34 are fastened to each other to carry the electronic device.

The location of the "I" type belt loop/snap arrangement 240 on pants 20 can be adjusted to a variety of selected locations. Belt loop/snap arrangement 240 can be made from a variety of fabrics and materials such as denim, leather or artificial leather. The size and shape of loop/snap arrangement 240 may also vary. In addition, more than one belt loop/snap arrangement 240 can be placed on the waist area of pants 20. Carrier or bag 26 may also be made from a variety of fabrics and materials such as denim, leather or artificial leather, etc. The design of bag 26 may vary for various mini compact electronic devices such as cellular phones, CD players, wireless internet communicators, wearable computers, etc. for use by travelers and military, police and firefighter personnel.

FIG. 2 shows a male snap part 28 fastened on belt loop 24. Two bar tacks or heavy stitches 30 are preferably sewn on the top and bottom of belt loop 24 over pants 20 for holding strength. Preferably ¼" top sewing stitches 32 are on belt loop 24. Male snap part 28 on belt loop/snap arrangement 240 can be switched with female snap part 34 fastened on bag 26 shown in FIG. 3. Belt loop 24 preferably has a finished size of about ¾" to ½"×2". The cover size of snap part 28 preferably is about ¼" to 9/16" in diameter. As shown in FIG. 2, the location of snap part 28 can be on the middle area of belt loop 24.

The general assembly process to form an "I" type belt loop/snap arrangement 240 is as follows:

Belt loop 24 is first sewn on the waist band 22 of pants 20. Two bar tacks or heavy stitches 30 may be sewn on the top and bottom of loop 24 through waist band 24. A hole is punched in belt loop 24, preferably at the center. Then male snap part 28 is positioned face-up on the outside or face of loop 24. The post part (not shown) of male snap part 28 is placed underneath loop 24 and then punched together through the center hole by a snap punch machine or tool to form an "I" type belt loop/snap arrangement 240. The female snap part 34 (shown in FIG. 3) is punched on the back side of bag 26. By snapping together male part 28 and female part 34, bag 26 with the mini compact electronic device stored inside will be fastened and held firmly on belt loop/snap arrangement 240 on pants 20.

FIG. 3 shows female snap part 34 fastened on the back side of bag 26 for carrying a mini compact electronic device such as a cellular phone. Snap parts 28 and 34 may be any known snaps and may be made from a variety of materials such as metal or plastic, etc. The location of snap part 28 on loop 24 and of snap part 34 on bag 26 may be adjusted in accordance with the needs and convenience of the wearer. As shown in FIG. 3, thread edge stitches 36 preferably extend around the perimeter of bag 26. If desired, snap part 34 can also be attached directly to the hard exterior of the mini compact device, for example, by a suitable adhesive.

Figure 4:
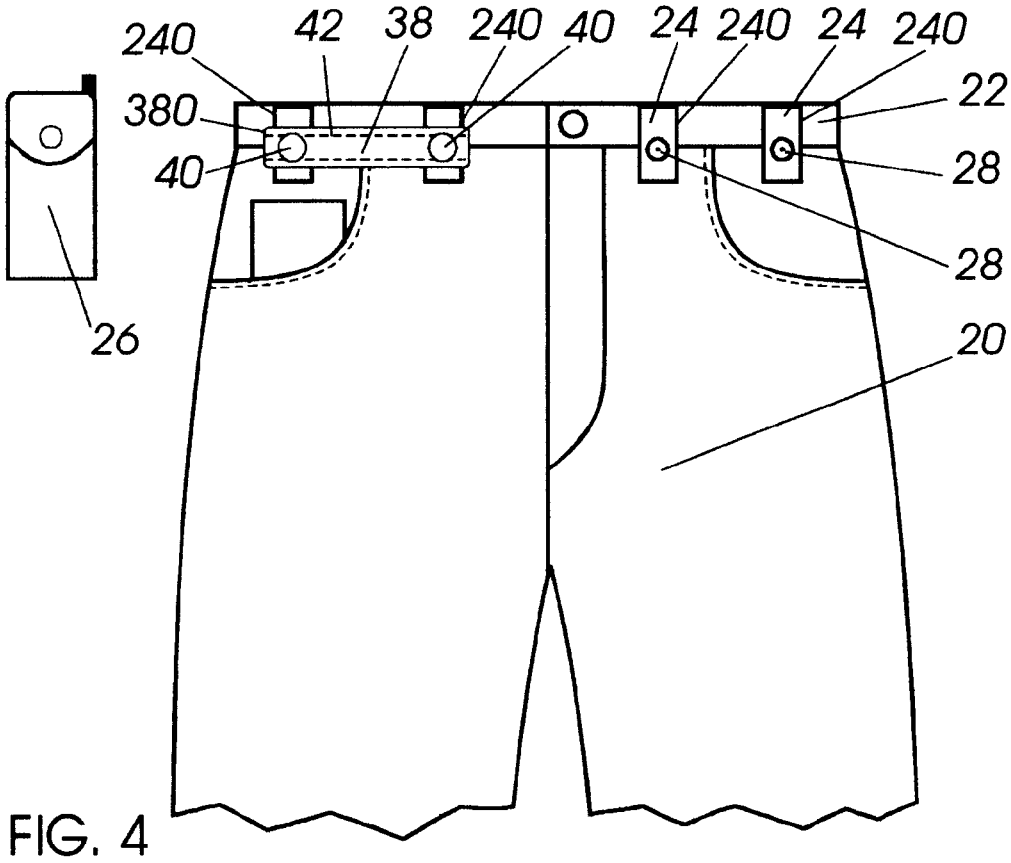
FIG. 4 is an enlarged front view of the upper portion of a pair of pants showing an "H" type belt loop and snap arrangement on the waist band area of the pants is accordance with another embodiment of the present invention.

FIG. 4 shows a second embodiment of the present invention in which at least two loops 24 for a belt sewn on the article of clothing 20 are used. As shown in FIG. 4, a long connecting loop 38 is preferably fastened on two belt loops 24 horizontally to form an "H" type belt loop/snap arrangement 380. Two snap fasteners 40 comprising male and female snap parts 28, 34 fasten long loop 38 on two vertical belt loop/snap arrangements 240 on loops 24. Snap fasteners 40 may be replaced with other fastening methods such as sewing stitches or rivets. Stitches 42 preferably extend around the edges of long loop 38, and if desired may be hidden from view (top stitch or clean finish).

Preferably more than one snap fastener part will be placed around the middle area of long loop 38 to fasten and hold securely the small bag 26 carrying a cellular phone or other mini compact electronic device. The location and length of long loop 38 can be adjusted according to various designs. Long loop 38 may be made from a variety of materials or fabrics such as denim, true/fake leathers, or decoration trims. In the embodiment shown in FIG. 4, at least two short vertical loops 24 are fastened to the waist area of pants 20. Horizontal loop 38 may also be fastened on pants 20 directly without using any vertical belt loop 24. The number and location of the short and long loops 24 and 38 can also be adjusted according to various designs. Snap parts 28, 34 and snap fastener 40 may be replaced with other types of fastening methods and devices such as eyelets, jean buttons or ties.

Figure 5:
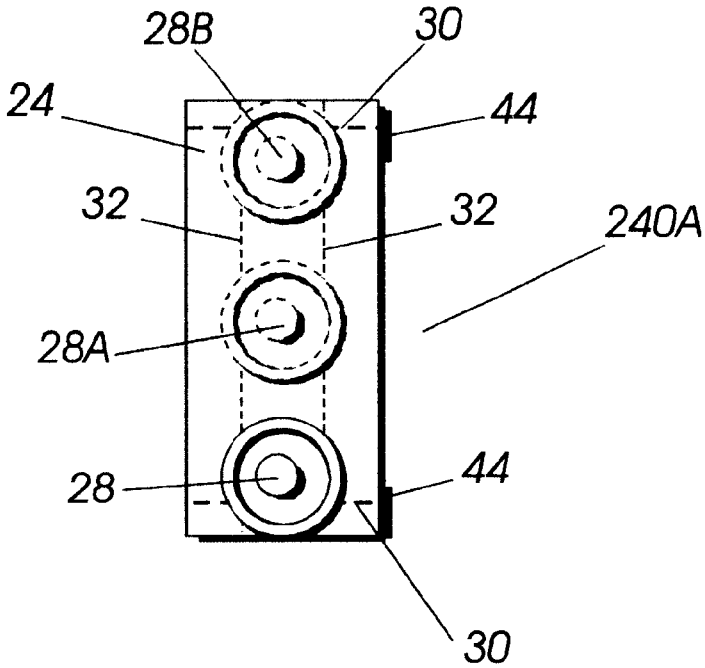
FIG. 5 is a perspective front view of another embodiment of the "I" type belt loop and snap arrangement according to the present invention.
Figure 6:
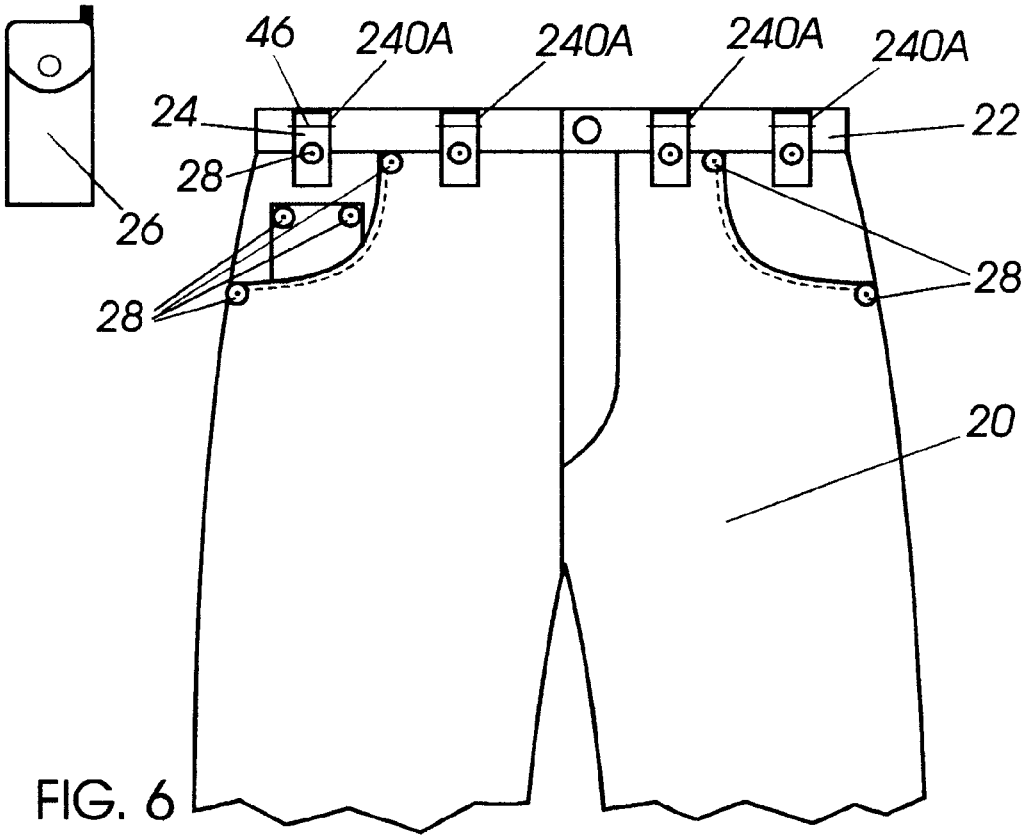
FIG. 6 is an enlarged front view of the upper portion of a pair of pants showing a further embodiment of the "I" type belt loop and snap arrangement using bar tacks to fasten the loops to the pants according to the present invention.

FIGS. 5–6 show another version of an "I" type belt loop/snap arrangement 240A in which third and fourth snap parts 28A and 28B adapted to mate with fifth and sixth snap parts are aligned with a first snap part 28 on at least one of loops 24. The fifth and sixth snap parts (not shown), which are similar to second snap part 34, are similarly aligned with the second snap part on the back of carrier 26.

As shown in FIG. 5, male snap part 28 is preferably punched at the bottom of belt loop. This location prevents a heavy cellular phone or electronic device in carrying case or bag 26 from dragging the belt loop/snap arrangement 240 down and pulling down the top of waistband 22 or the top edge of pants 22. Preferably, the back folded ends 44 of belt loop 24 may also be adjusted to vary the relative location of male snap part 28 to the waist area. Another way to solve the "pull-down" problem is to add an additional bar tack 46 about ⅜" below the top of belt loop 24 when snap part 28 is in the middle area of belt loop 24. Bar tack 46 provides stronger support in holding loop/snap arrangement 240A and pants 20 together and prevents the top of waistband 22 or the top edge of pants 20 from being pulled down from the weight of the electronic device. The length of bar tack 46 can be adjusted depending on the particular needs or intended application. In addition, although three snap parts 28, 28A and 28B are shown in FIG. 5, one, two or more than three may also be used. Preferably, when more than two or three snap parts 28, 28A, 28B are used, they are horizontally or vertically aligned on belt loop 24 or for the embodiment shown in FIG. 4 on long loop 38.

As shown in FIG. 6, snap parts 28 can also be placed at the corners of pockets of pants 20 in place of the rivets that often appear, for example, on jeans. In such case, the snap parts serve not only to strengthen the seams of the pockets but also to provide the wearer with more locations to fasten the carrier bag 26 to pants 20. Male snap parts 28 can be replaced with female snap parts 34. In that case, carrier 26 will have male snap part 28. The size and shape of snap parts 28, 34 may also vary according to various designs.

Figure 7:
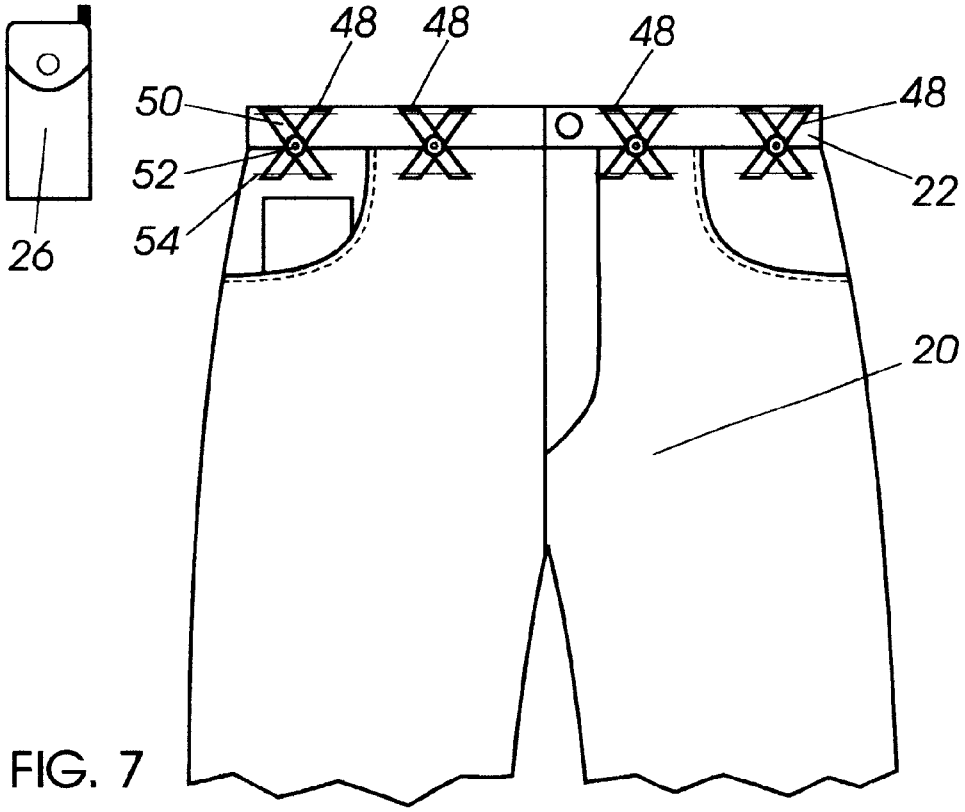
FIG. 7 is an enlarged front view of the upper portion of a pair of pants showing an "X" type cross belt loop, snap and bar tack arrangement in accordance with a further embodiment of the present invention.

FIG. 7 shows an "X" type cross belt loop/snap arrangement 48 and method of assembly in which at least two intersecting loops 50 are fastened to an article of clothing 20. A first fastener part 52 adapted to mate with a second fastener part on carrier 26 is fastened at the location where loops 50 intersect and is fastened to the second fastener part to carry the electronic device. The cross belt loop/snap arrangement 48 is designed to hold compact electronic devices more strongly and securely as another way to solve the waist band top pulling problem. As shown in FIG. 7, two loops 50 overlap each other in the form of a large "X" to serve as the base of the cross belt loop/snap arrangement 48. The two top ends of cross loops 50 are aligned with each other and sewn on the top of waistband 22 of pants 20. The two bottom ends of cross belt loop/snap arrangement 48 are likewise aligned with each other and sewn on the under area of waistband 22. Bar tacks or heavy stitches 54 are sewn on the tops and bottoms of cross loops 50. Preferably, the two cross loops are not sewn together but rather a hole (not shown) is punched in the two cross loops 50 where they overlap. A post (not shown) without a cover comprising an eyelet hole and column is put underneath the overlap point of the two cross loops 50. A socket part (not shown) is put on the top of the overlap point of the two cross loops 50. The post is connected with the socket through the punched hole and then punched together with a snap punch machine or tool to form a special female snap part 52 on the face of cross loop/snap arrangement 48. Female snap part 52 can also be replaced with any male snap part or other kind of fastener. The size, shape and material of belt loops 50 and snap part 52 and bar tacks 54 may vary according to the needs and requirements of the wearer.

For pants or skirts without waistbands, cross loop/snap arrangement 48 can be simply sewn directly on the garment as a fake belt loop. In addition, the cross loops 50 may be positioned so that their lower ends intersect and thereby form a "V" type belt loop/snap arrangement.

Figure 8:
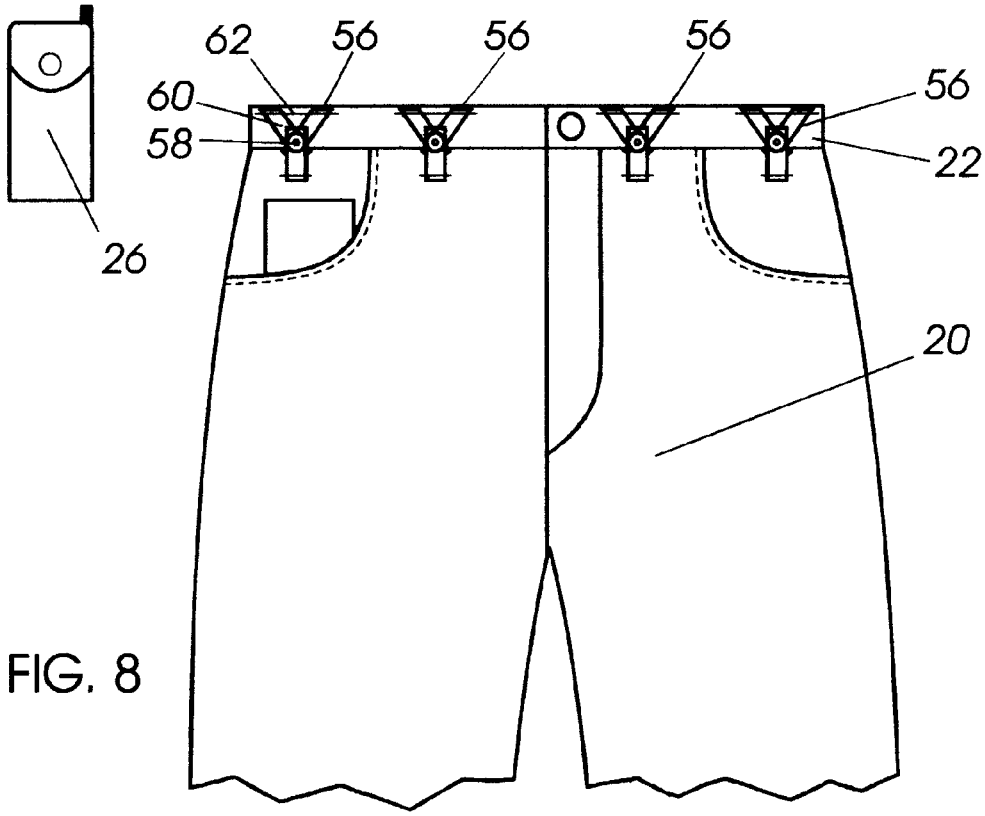
FIG. 8 is an enlarged front view of the upper portion of a pair of pants showing a "Y" type belt loop, snap and bar tack arrangement according to an additional embodiment of the present invention.

FIG. 8 shows a "Y" type belt loop/snap arrangement 56 and method of assembly in which a third loop is fastened to the article of clothing 22 so that the third loop intersects the first and second loops at an intersecting location, and the first fastener part is fastened to the first, second and third loops so that the loops are fastened in the form of a "Y".

The "Y" type belt loop/snap arrangement 56 provides another method to solve the waistband pulling problem when carrying heavy electronic devices like cellular phones or wearable computers. In the embodiment shown in FIG. 8, three loops 60, preferably being ½" to ¾" in width, are positioned to form a "Y" type base. A female snap part 58 or male snap part (not shown) is placed at the overlap point of the three loops 60 forming the "Y" and punched to form a "Y" type belt loop/snap arrangement 56. Belt loop/snap arrangement 56 is then sewn on waistband 22 of pants 20 with bar tacks or strong stitches 62. When heavy denim fabrics are used, in order to reduce the thickness of the overlap point of the three loops 60, each loop 60 preferably is folded only at the right and left back side edges and then cover-stitched or chain stitched. The top and bottom of each loop 60 are also bent back and stitched. With this arrangement, the middle area of each loop 60 is still a single layer, so the area of intersection of the "Y" type belt loop/snap arrangement 56 has only a three layer overlap. As with the other embodiments discussed above, snap part 58 may be replaced with any kind of fastener and the size, shape and material of belt loops 60, snap part 58, and bar tacks 62 may vary according to various designs.

Thus, a method and assembly for fastening an electronic device to an article of clothing is provided which uses belt loops and snaps on pants to hold the small bag typically used to carry mini compact electronic devices like cellular phones. The method and assembly when applied, for example, to a wearer's jeans not only provides an easy and convenient way to carry mini compact electronic devices such as cellular phones, but also serves as an attractive decoration like jean rivets when not being used to fasten an electronic device. In addition, in accordance with the invention, mini compact electronic devices may be carried on a wearer's pants easily or conveniently without using a waist belt.

Accordingly, while a few embodiments of the present invention have been shown and described, it is to be understood that many changes and modifications may be made thereunto without departing from the spirit and scope of the invention as defined in the appended claims.

What is claimed is:

1. A method for fastening an electronic device onto an article of clothing having a plurality of loops for a belt sewn on the article of clothing, which comprises:

(a) fastening to one of the loops a first snap part adapted to mate with a second snap part;

(b) fastening the second snap part to an element selected from the group consisting of the electronic device and a carrier for the electronic device;

(c) fastening to said one of the loops third and fourth snap parts adapted to mate with fifth and sixth snap parts, respectively, said first, third and fourth snap parts being aligned on said one of the loops;

(d) fastening the fifth and sixth snap parts to said element selected from the group consisting of the electronic device and a carrier for the electronic device, said second, fifth and sixth snap. parts being aligned on said element; and (e) fastening the first snap part to the second snap part, the third snap part to the fifth snap part and the fourth snap part to the sixth snap part.

2. An assembly for fastening an electronic device onto an article of clothing having a plurality of loops for a belt sewn on the article of clothing which comprises:

(a) a carrier for the electronic device;

(b) a fastener comprising a male snap part and a female snap part, said male snap part fastened to one of the elements selected from the group consisting of (i) the carrier and (ii) one of the loops, said female snap part fastened to the other of the elements selected from the group consisting of (i) the carrier and (ii) one of the loops; and (c) second and third fasteners, each of said second and third fasteners comprising a male snap part and a female snap part, each of said male snap parts fastened to one of the elements selected from the group consisting of the carrier and said one of the loops, each of said female snap parts fastened to the other of the elements selected from the group consisting of the carrier and said one of the loops, said first, second and third fasteners being aligned on said one of the loops.

3. An assembly for fastening an electronic device onto an article of clothing having at least two belt loops for a belt sewn on the article of clothing which comprises:

(a) a carrier for the electronic device;

(b) a connecting loop adapted to be disposed between the two belt loops;

(c) first, second and third fasteners, each of said fasteners comprising a male snap part and a female snap part, said male snap parts of said first and second fasteners fastened to one of the elements selected from a first group consisting of the connecting loop and one of the two belt loops, said female snap parts fastened to the other of the elements from the first group, said male snap part of said third fastener fastened to one of the elements selected from a second group consisting of the connecting loop and the carrier, said female snap part of the third fastener fastened to the other of the elements selected from the second group.

4. A method for fastening an electronic device onto an article of clothing having a plurality of loops for a belt sewn on the article of clothing, which comprises:

(a) providing to one of the loops a first fastener part adapted to mate with a second fastener part;

(b) providing the second fastener part to an element selected from the group consisting of the electronic device and a carrier for the electronic device;

(c) providing to said one of the loops third and fourth fastener parts adapted to mate with fifth and sixth fastener parts, respectively, said first, third and fourth fastener parts being aligned on said one of the loops;

(d) providing the fifth and sixth fastener parts to said element selected from the group consisting or the electronic device and a carrier for the electronic device, said second, fifth and sixth snap parts being aligned on said element; and (e) fastening the first fastener part to the second fastener part, the third fastener part to the fifth fastener part and the fourth fastener part to the sixth fastener part.

5. The method according to claim 4 wherein said first and second fastener parts, said third and fifth fastener parts, and said fourth and sixth fastener parts each form a respective fastener selected from the group consisting of a button and an eyelet, and a tie and an eyelet.

6. An assembly for fastening an electronic device onto an article of clothing having a plurality of loops for a belt sewn on the article of clothing which comprises:

(a) a carrier for the electronic device; and (b) first, second and third fasteners, each of said first, second and third fasteners comprising a first fastener part and a second fastener part, each of said first fastener parts provided to one of the elements selected from the group consisting of (i) the carrier and (ii) one of the loops, each of said second fastener parts provided to the other of the elements selected from the group consisting of (i) the carrier and (ii) one of the loops, said first, second and third fasteners being aligned on said one of the loops.

7. The assembly according to claim 6 wherein said first, second and third fasteners are selected from the group consisting of a button and an eyelet, and a tie and an eyelet.

8. An assembly for fastening an electronic device onto an article of clothing having at least two belt loops for a belt sewn on the article of clothing which comprises:

(a) a carrier for the electronic device;

(b) a connecting loop adapted to be disposed between the two belt loops;

(c) first, second and third fasteners, each of said fasteners comprising a first fastener part and a second fastener part, said first fastener parts of said first and second fasteners provided to one of the elements selected from a first group consisting of the connecting loop and one of the two belt loops, said second fastener parts provided to the other of the elements from the first group, said first fastener part of said third fastener provided to one of the elements selected from a second group consisting of the connecting loop and the carrier, said second fastener part of the third fastener provided to the other of the elements selected from the second group.

9. The assembly according to claim 8 wherein said first, second and third fasteners are selected from the group consisting of a button and an eyelet, and a tie and an eyelet.

* * * * *